US009299279B2

(12) United States Patent
Chung et al.

(10) Patent No.: US 9,299,279 B2
(45) Date of Patent: Mar. 29, 2016

(54) DISPLAY DEVICE, INSPECTING AND DRIVING METHOD THEREOF

(71) Applicant: SAMSUNG DISPLAY CO., LTD., Yongin-si, Gyeonggi-do (KR)

(72) Inventors: Bo-Yong Chung, Yongin-si (KR); Jung-Mi Choi, Yongin-si (KR); Yong-Jae Kim, Yongin-si (KR); Young-In Hwang, Yongin-si (KR); Seong-Il Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 213 days.

(21) Appl. No.: 13/668,191

(22) Filed: Nov. 2, 2012

(65) Prior Publication Data

US 2013/0321644 A1 Dec. 5, 2013

(30) Foreign Application Priority Data

Jun. 1, 2012 (KR) ..... 10-2012-0059330

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2300/08* (2013.01); *G09G 2310/0267* (2013.01); *G09G 2310/0286* (2013.01); *G09G 2330/02* (2013.01); *G09G 2330/04* (2013.01)

(58) Field of Classification Search
CPC ..... H04N 17/00
USPC ..... 345/211; 348/184, E17.001; 377/64
See application file for complete search history.

(56) References Cited

U.S. PATENT DOCUMENTS

| | | | | |
|---|---|---|---|---|
| 6,753,836 | B2 * | 6/2004 | Kwon | 345/87 |
| 7,009,418 | B2 * | 3/2006 | Orii et al. | 324/760.02 |
| 8,040,293 | B2 * | 10/2011 | Jeong | 345/46 |
| 2007/0242000 | A1 * | 10/2007 | Shin | 345/76 |
| 2007/0248204 | A1 * | 10/2007 | Tobita | 377/64 |
| 2008/0309605 | A1 * | 12/2008 | Jang et al. | 345/92 |
| 2010/0238094 | A1 * | 9/2010 | Cho et al. | 345/82 |
| 2012/0133626 | A1 | 5/2012 | Chung et al. | |

FOREIGN PATENT DOCUMENTS

| | | | |
|---|---|---|---|
| JP | 2010-186551 | A | 8/2010 |
| KR | 10-2004-0103918 | A | 12/2004 |
| KR | 10-2011-0097569 | A | 8/2011 |
| KR | 10-2011-0104320 | A | 9/2011 |
| KR | 10-2012-0058204 | | 6/2012 |

* cited by examiner

*Primary Examiner* — Kathy Wang-Hurst
*Assistant Examiner* — Matthew Yeung
(74) *Attorney, Agent, or Firm* — Lewis Roca Rothgerber Christie LLP

(57) ABSTRACT

A display device according to the present invention includes: a display unit including a plurality of pixels coupled to a plurality of scan lines; a plurality of scan driving blocks coupled to the plurality of scan lines and adapted to apply a plurality of scan signals; an electrostatic discharge (ESD) unit adapted to protect the plurality of scan driving blocks from static charges; an AC power source unit for supplying a first power source voltage of which a level is changed between a logic high level and a logic low level, to the plurality of scan driving blocks through a first power source voltage wire during a pixel test of the plurality of pixels; and a DC power source unit for supplying a second power source voltage of the logic high level to the ESD unit through a second power source voltage wire.

13 Claims, 6 Drawing Sheets

DISPLAY DEVICE, INSPECTING AND DRIVING METHOD THEREOF

CROSS-REFERENCE TO RELATED APPLICATION

This application claims priority to and the benefit of Korean Patent Application No. 10-2012-0059330 filed in the Korean Intellectual Property Office on Jun. 1, 2012, the entire contents of which are incorporated herein by reference.

BACKGROUND (a) Field

Embodiments of the present invention relate to a display device, a method for testing the display device, and a method for driving the display device.

(b) Description of the Related Art

A display device includes a display panel composed of a plurality of pixels arranged in a matrix. The display panel includes a plurality of scan lines arranged in a row direction and a plurality of data lines arranged in a column direction, and the plurality of scan lines and the plurality of data lines cross each other. The plurality of pixels are respectively driven by scan signals and data signals transmitted from the respectively corresponding scan lines and data lines.

Static charges that may be generated from human body contact may flow to an internal circuit of the display device. The static charges may cause a high voltage pulse, and the high voltage pulse can cause damage to the internal circuit. The display device is provided with an electrostatic charge (ESD) protection circuit for protecting the internal circuit from damage due to the high voltage pulse. The ESD protection circuit prevents the static charges from flowing into the internal circuit and flows the static charges to a ground instead.

A power source voltage is supplied to the ESD protection circuit for driving thereof, and the power source voltage is also used as a driving voltage of a scan driver that generates a scan signal. The power source voltage supplied to the ESD protection circuit needs to be applied as a DC voltage. However, a level of the power source voltage supplied to the scan driver needs to be changed for a pixel test.

When the voltage level of the power source voltage is changed for the pixel test, a level of the power source voltage supplied to the ESD protection circuit is also changed, and accordingly, the ESD protection circuit performs erroneous operation. Due to the erroneous operation of the ESD protection circuit, an internal circuit of the display device may be directly exposed to a high voltage pulse.

The above information disclosed in this Background section is only for enhancement of understanding of the background of the invention and therefore may contain information that does not form the prior art that is already known in this country to a person of ordinary skill in the art.

SUMMARY

The present invention has been made in an effort to provide a display device that can improve detection efficiency of a pixel test and prevent erroneous operation of an ESD protection circuit, a test method of the display device, and a driving method of the display device.

A display device according to an exemplary embodiment of the present invention includes: a display unit including a plurality of pixels coupled to a plurality of scan lines; a plurality of scan driving blocks coupled to the plurality of scan lines and adapted to apply a plurality of scan signals; an electrostatic discharge (ESD) unit adapted to protect the plurality of scan driving blocks from static charges; an AC power source unit for supplying a first power source voltage of which a level is changed between a logic high level and a logic low level to the plurality of scan driving blocks through a first power source voltage wire during a pixel test of the plurality of pixels; and a DC power source unit for supplying a second power source voltage of the logic high level to the ESD unit through a second power source voltage wire.

During the pixel test, the first power source voltage wire may be coupled to the AC power source unit, and after completion of the pixel test, the first power source voltage wire may be coupled to the DC power source unit.

Each of the plurality of scan driving blocks may include: a first node to which a clock signal input to a first clock signal input terminal is transmitted; a second node to which an input signal is transmitted according to a clock signal input to a second clock signal input terminal; a first transistor including a gate electrode coupled to the first node, a first electrode to which one of the first power source voltage or the second power source voltage is applied, and a second electrode coupled to an output terminal; and a second transistor including a gate electrode coupled to the second node, a first electrode coupled to a third clock signal input terminal, and a second electrode coupled to the output terminal.

Each of the plurality of scan driving blocks may further include a first capacitor including a first electrode coupled to the second node and a second electrode coupled to the output terminal.

Each of the plurality of scan driving blocks may further include a second capacitor including a first electrode to which one of the first power source voltage or the second power source voltage is applied, and a second electrode coupled to the first node.

Each of the plurality of scan driving blocks may further include a third transistor including a gate electrode coupled to the second clock signal input terminal, a first electrode to which the input signal is applied, and a second electrode coupled to the second node.

Each of the plurality of scan driving blocks may further include a fourth transistor including a gate electrode coupled to the first clock signal input terminal, a first electrode coupled to the first clock signal input terminal, and a second electrode coupled to the first node.

Each of the plurality of scan driving blocks may further include: a fifth transistor including a gate electrode to which the input signal is input and a first electrode coupled to the first clock signal input terminal; and a sixth transistor including a gate electrode coupled to the second clock signal input terminal, a first electrode coupled to a second electrode of the fifth transistor, and a second electrode coupled to the first node.

Each of the plurality of scan driving blocks may further include a seventh transistor including a gate electrode coupled to the third clock signal input terminal and a first electrode coupled to the second node and an eighth transistor including a gate electrode coupled to the first node, a first electrode coupled to a second electrode of the seventh transistor, and a second electrode coupled to the output terminal.

The DC power source unit may be adapted to supply a third power source voltage of the logic low level to the ESD unit through a third power source voltage wire.

A testing method of a display device according to another exemplary embodiment of the present invention includes: concurrently outputting a plurality of scan signals from a plurality of scan driving blocks by connecting a first power source voltage wire coupled to the plurality of scan driving blocks to an AC power source unit and changing a level of a first power source voltage applied to the first power source voltage wire; and connecting the first power source voltage wire to a DC power source unit that supplies a second power source voltage of a logic high level to an electrostatic discharge (ESD) unit that protects the plurality of scan driving blocks from static charges, through a second power source voltage wire.

Each of the plurality of scan driving blocks may include: a first node to which a clock signal input to a first clock signal input terminal is transmitted; a first transistor having a gate electrode coupled to the first node and adapted to transmit one of the first power source voltage or the second power source voltage to an output terminal; and a capacitor including a first electrode coupled to one of the first power source voltage or the second power source voltage, and a second electrode coupled to the first node, and the concurrently outputting the plurality of scan signals from the plurality of scan driving blocks may include: changing a voltage of the first node by changing the first power source voltage; turning on the first transistor by the voltage changing of the first node; and outputting the first power source voltage through the output terminal.

A driving method according to another exemplary embodiment of the present invention is provided to a display device including a plurality of scan driving blocks, each of the scan driving blocks including: a first node to which a clock signal input to a first clock signal input terminal is transmitted; a second node to which an input signal is transmitted according to a clock signal input to a second clock signal input terminal; a first transistor including a gate electrode coupled to the first node and adapted to transmit a first power source voltage to an output terminal; and a second transistor including a gate electrode coupled to the second node and adapted to transmit a clock signal input to a third clock signal input terminal to the output terminal. The driving method includes: applying a second power source voltage to the plurality of scan driving blocks by connecting a first power source voltage wire that transmits the first power source voltage, to a DC power source unit that supplies the second power source voltage of a logic high level through a second power source voltage wire to an electrostatic discharge (ESD) unit that protects the plurality of scan driving blocks from static charges; and sequentially outputting a plurality of scan signals by applying a plurality of clock signals to the plurality of scan driving blocks.

The sequentially outputting the plurality of scan signals may include: inputting a first clock signal to the first clock signal input terminal of each of the plurality of scan driving blocks; inputting a second clock signal that is shifted by ½ duty from the first clock signal, to a second clock signal input terminal of each of the plurality of scan driving blocks; inputting a third clock signal that is shifted by ½ duty from the second clock signal, to a third clock signal input terminal of each of the plurality of scan driving blocks; and outputting a scan signal synchronized by the third clock signal.

The plurality of scan driving blocks included in the scan driver concurrently (e.g., simultaneously) output scan signals to improve detection efficiency of a pixel test and prevent erroneous operation of the ESD protection circuit.

DETAILED DESCRIPTION OF THE EMBODIMENTS

Figure 1:
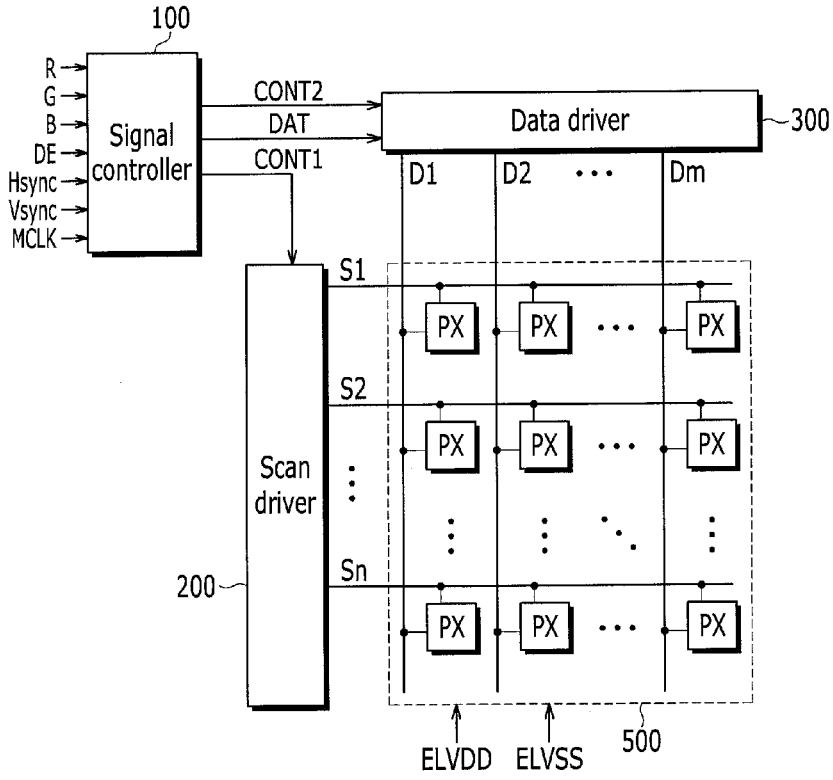
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In several embodiments, the same reference numerals are used for the elements having the same configuration to representatively explain the elements in a first embodiment, and only a different configuration from that of the first embodiment will be described in other embodiments.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an exemplary embodiment of the present invention.

Referring to FIG. 1, the display device includes a signal controller 100, a scan driver 200, a data driver 300, and a display unit 500.

The signal controller 100 receives video signals R, G, and B input from an external device and an input control signal for controlling displaying of the video signals. The video signals R, G, and B include luminance information of each pixel PX, and the luminance information has a set or predetermined number of grays or gray levels, for example, $1024=2^{10}$, $256=2^{8}$, or $64=2^{6}$. The input control signal exemplarily includes a vertical synchronization signal Vsync, a horizontal synchronization signal Hsync, a main clock signal MCLK, and a data enable signal DE.

The signal controller 100 processes the input video signals R, G, and B based on the input video signals R, G, and B and the input control signal according to an operating condition of the display unit 500 and the data driver 300, and generates a scan control signal CONT1, a data control signal CONT2, and an image data signal DAT. The signal controller 100 transmits the scan control signal CONT1 to the scan driver 200. The signal controller 100 transmits the data control signal CONT2 and the image data signal DAT to the data driver 300.

The display unit 500 includes a plurality of scan lines S1-Sn, a plurality of data lines D1-Dm, and a plurality of pixels PX coupled to the plurality of signal lines (S1-Sn and D1-Dm) and arranged substantially in a matrix format. The plurality of scan lines S1-Sn are extended substantially in a row direction and substantially parallel with each other. The plurality of data lines D1-Dm are extended in a column direction and substantially parallel with each other. The plurality of pixels PX of the display unit 500 receive a first power source voltage ELVDD and a second power source voltage ELVSS.

The scan driver 200 is coupled to the plurality of scan lines S1-Sn, and applies a scan signal to the plurality of scan lines S1 to Sn. The scan signal is formed of a combination of a gate-on voltage Von that turns on application of a data signal with respect to the pixel PX, and a gate-off voltage Voff that turns off the application of the data signal, according to the scan control signal CONT1.

The scan control signal CONT1 includes a scan start signal SSP, a clock signal SCLK, and the like. The scan start signal SSP is a signal that generates the first scan signal for displaying an image of a frame. The clock signal SCLK is a synchronization signal for sequential application of the scan signal to the plurality of scan lines S1-Sn.

The data driver 300 is coupled to the plurality of data lines D1-Dm, and selects a gray level voltage according to the image data signal DAT. The data driver 300 applies a gray level voltage selected according to the data control signal CONT2 to the plurality of data lines D1 to Dm as a data signal.

Each of the controller or drivers 100, 200, and 300 described above may be mounted outside a pixel area as at least one integrated circuit, mounted on a flexible printed circuit film, attached to the display unit 500, as a tape carrier package (TCP), mounted on a separate printed circuit board, or integrated outside the pixel area together with the signal lines (S1-Sn and D1-Dm).

The display device undergoes a pixel test that tests lighting and array of pixels, after being produced according to a manufacturing process. During the pixel test, the scan driver 200 concurrently (e.g., simultaneously) outputs the plurality of scan signals using a VGH power source voltage. The display device, being a product after the pixel test, sequentially outputs the plurality of scan signals using a VDH power source voltage. The VGH power source voltage is an AC voltage, and the VDH power source voltage is a DC voltage. That is, during the pixel test, the display device can concurrently (e.g., simultaneously) output the plurality of scan signals using the AC voltage, and can concurrently (e.g., simultaneously) output the plurality of scan signals using the DC voltage after being manufactured.

If the scan signals are sequentially output and then the pixel test is performed, the scan signal cannot be output when a scan driving block has a lighting error, so that the lighting and array test may not be performed on all of the pixels. Thus, the pixel test should be performed through light emission of all pixels by concurrently (e.g., simultaneously) outputting the plurality of scan signals during the pixel test.

Hereinafter, a configuration of the scan driver 200 during the pixel test and a configuration of a manufactured scan driver 200 after the pixel test will be described with reference to FIG. 2 and FIG. 3.

Figure 2:
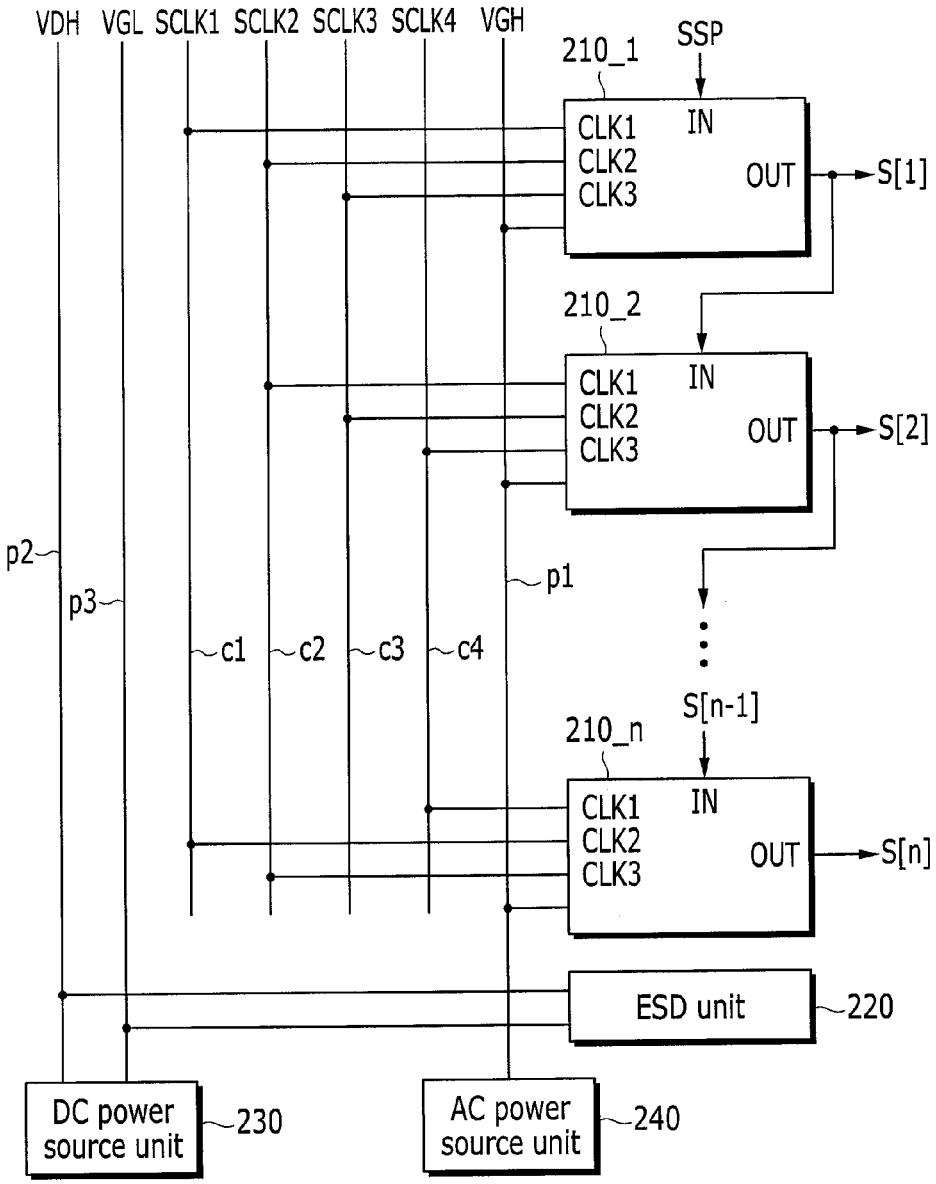
FIG. 2 is a block diagram of a configuration of a scan driver in a pixel test according to an exemplary embodiment of the present invention.

FIG. 2 is a block diagram of a configuration of the scan driver during the pixel test according to an exemplary embodiment of the present invention.

Referring to FIG. 2, the scan driver includes a plurality of scan driving blocks 210_1, 210_2, . . . , **210_*n* that are sequentially arranged. The scan driving blocks 210_1, 210_2, . . . , 210_*n* generate scan signals S[1], S[2], S[n] that are respectively transmitted to the plurality of scan lines S1**-Sn.

Each of the plurality of scan driving blocks 210_1, 210_2, . . . , and **210_*n* includes a first clock signal input terminal CLK1, a second clock signal input terminal CLK2, a third clock signal input terminal CLK3**, an input signal input terminal IN, and an output terminal OUT.

The plurality of scan driving blocks 210_1, 210_2, . . . , **210_*n* are respectively coupled to three clock signal wires among a first clock signal wire c1, a second clock signal wire c2, a third clock signal wire c3, and a fourth clock signal wire c4. The first clock signal input terminal CLK1, the second clock signal input terminal CLK2, and the third clock signal input terminal CLK3 of each of the plurality of scan driving blocks 210_1, 210_2, . . . , and 210_*n* respectively receive corresponding three of a first clock signal SCLK1, a second clock signal SCLK2, a third clock signal SCLK3, and a fourth clock signal SCLK4**.

The first scan driving block 210_1 receives the first clock signal SCLK1, the second clock signal SCLK2, and the third clock signal SCLK3. The second scan driving block 210_2 receives the second clock signal SCLK2, the third clock signal SCLK3, and the fourth clock signal SCLK4. Three of the four clock signals SCLK1 to SCLK4 are rotationally input to the plurality of sequentially arranged scan driving blocks 210_1, 210_2, . . . , and **210_*n***.

The plurality of scan driving blocks 210_1, 210_2, . . . , and **210_*n* are respectively coupled with a first power source voltage wire p1. The first power source voltage wire p1** is applied with a first power source voltage VGH. The first power source voltage VGH is an AC voltage that is changed between a logic low voltage and a logic high voltage. For example, the first power source voltage VGH may be changed between a voltage of −5V and a voltage of 15V.

The input signal input terminals IN of the plurality of scan driving blocks 210_1, 210_2, . . . , and **210_*n* receive scan signals of the previously arranged scan driving blocks. That is, an input signal input terminal IN of the k-th scan driving block 210_*k* receives a scan signal S[k−1] of the (k−1)th scan driving block 210_(*k*−1). In this case, the input signal input terminal IN of the first scan driving block 210_1** receives a scan start signal SSP.

The scan driving blocks 210_1, 210_2, . . . , and **210_*n* respectively output scan signals S[1], S[2], . . . , and S[n] generated according to signals input to the first clock signal input terminal CLK1, the second clock signal input terminal CLK2, the third clock signal input terminal CLK3**, and the input signal input terminal IN, through their output terminals OUT.

The first scan driving block 210_1 transmits the scan signal S[1] generated by receiving the scan start signal SSP, to both the first scan line S1 and the input signal input terminal IN of the second scan driving block 210_2. The k-th scan driving block **210_*k* outputs a scan signal S[k] generated by receiving a scan signal S[k−1] that is output from the (k−1)th scan driving block 210_(*k*−1)** (1<k<=n).

The scan driver 200 may further include an electrostatic discharge (ESD) unit 220, a DC power source unit 230, and an AC power source unit 240. It is exemplarily described that the ESD unit 220, the DC power source unit 230, and the AC power source unit 240 are included in the scan driver 200, but, in several embodiments, at least one of the ESD unit 220, DC power source unit 230, and AC power source unit 240 may be provided separated from the scan driver 200.

The ESD unit 220 is coupled with the second power source voltage wire p2 and the third power source voltage wire p3.

The ESD unit 220 prevents electrostatic charges from flowing to the plurality of scan driving blocks 210_1, 210_2, . . . , and **210_*n* by using a second power source voltage VDH and a third power source voltage VGL to thereby protect the plurality of scan driving blocks 210_1, 210_2, . . . , and 210_*n*** from the electrostatic charges. The second power source voltage VDH is a DC voltage of logic high, and the third power source voltage VGL is a DC voltage of logic low.

The DC power source unit 230 is coupled with the second power source voltage wire p2 and the third power source voltage wire p3. The DC power source unit 230 supplies the second power source voltage VDH to the second power source voltage wire p2 and supplies the third power source voltage VGL to the third power source voltage wire p3.

The AC power source unit 240 is coupled to the first power source voltage wire p1 and supplies the first power source voltage VGH thereto. The AC power source unit 240 changes the first power source voltage VGH to a gate-on voltage from a gate-off voltage during the pixel test. The gate-on voltage is a voltage that turns on transistors included in the respective scan driving blocks 210_1, 210_2, . . . , and **210_*n*, and the gate-off voltage is a voltage that turns off the transistors included in the respective scan driving blocks 210_1, 210_2, . . . , and 210_*n***.

The AC power source unit 240 may be a first power source pad including a circuit that supplies the first power source voltage VGH, and the DC power source unit 230 may be a second power source pad including a circuit for supplying the second power source voltage VDH. That is, the DC power source unit 230 and the AC power source unit 240 may be formed of two separate power source pads.

Since the plurality of clock signals SCLK1 to SCLK4 are applied as the gate-on voltage, and the first power source voltage VGH is applied as the gate-on voltage changed from the gate-off voltage during the pixel test, the plurality of scan driving blocks 210_1, 210_2, . . . , and **210_*n*** concurrently (e.g., simultaneously) output scan signals of the gate-on voltage.

Figure 3:
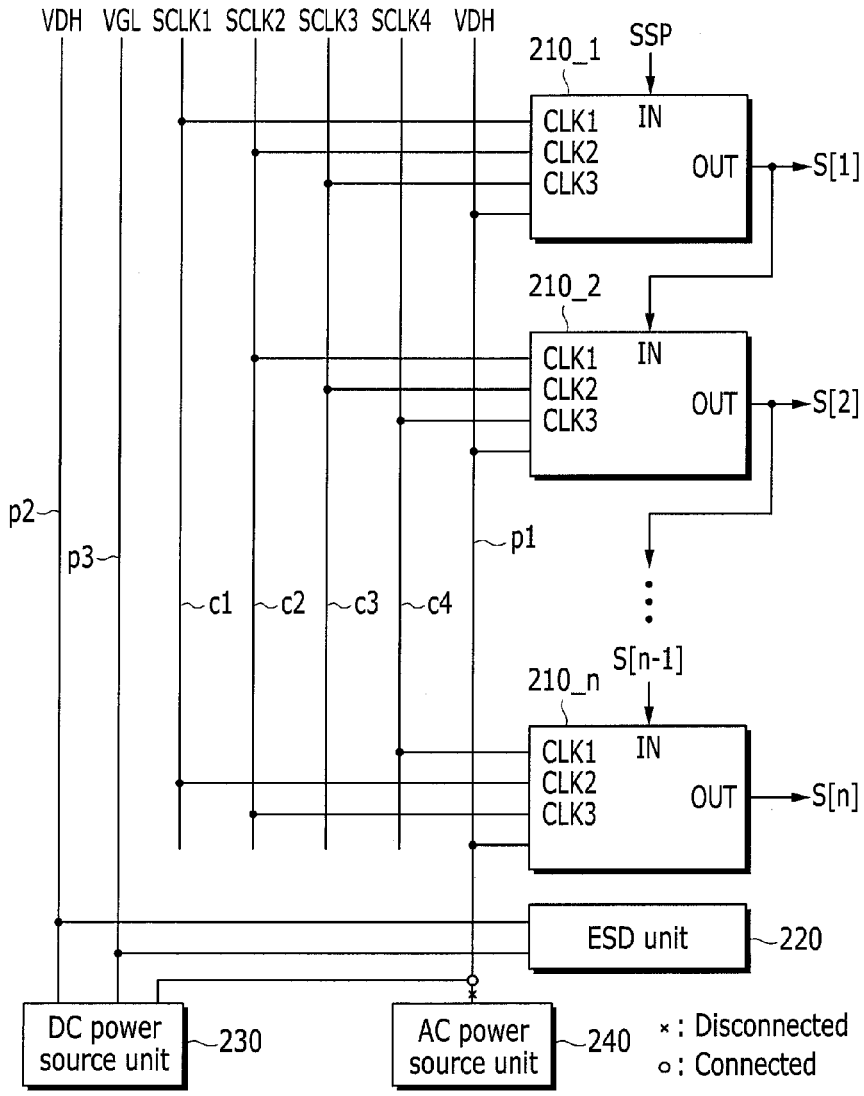
FIG. 3 is a block diagram of a configuration of a manufactured scan driver after completion of a pixel test according to an exemplary embodiment of the present invention.

FIG. 3 is a block diagram of a configuration of a manufactured scan driver after completion of the pixel test according to an exemplary embodiment of the present invention.

Referring to FIG. 3, a difference between the configuration of the scan driver in the pixel test of FIG. 2 and that of FIG. 3 will be mainly described.

When the pixel test is completed, the first power source voltage wire p1 is disconnected from the AC power source unit 240. Then, the first power source voltage wire p1 is coupled with the DC power source unit 230. The DC power source unit 230 supplies the second power source voltage VDH to the first power source voltage wire p1. Alternatively, when the pixel test is completed, the DC power source unit 230 and the AC power source unit 240 are connected to a source PCB, and the first power source voltage wire p1 is coupled to the DC power source unit 230 such that the second power source voltage VDH can be supplied to the first power source voltage wire p1.

Since the second power source voltage wire p2 for the ESD unit 220 is separately provided from the first power source voltage wire p1 that is provided for driving of the scan driver, the AC power source unit 240 applies an AC voltage to the first power source voltage wire p1 while the ESD unit 220 being normally driven by the second power source voltage VDH and the third power source voltage VGL such that the plurality of scan signals S[1], S[2], . . . , and S[n] can be concurrently (e.g., simultaneously) output during the pixel test.

When the second power source voltage wire p2 is not independently provided and the ESD unit 220 is coupled to the first power source voltage wire p1, the ESD unit 220 may malfunction when the first power source voltage wire p1 is applied with the AC voltage for the pixel test. Due to the erroneous operation of the ESD unit 220, an internal circuit of the display device may be directly exposed to a high voltage pulse caused by the electrostatic charges.

Hereinafter, circuit configurations of the plurality of scan driving blocks 210_1, 210_2, . . . , and **210_*n*** will be described, and concurrent (e.g., simultaneous) output of the scan signals from the scan driver during the pixel test and sequential output of the scan signals from the manufactured scan driver after completion of the pixel test will be described.

Figure 4:
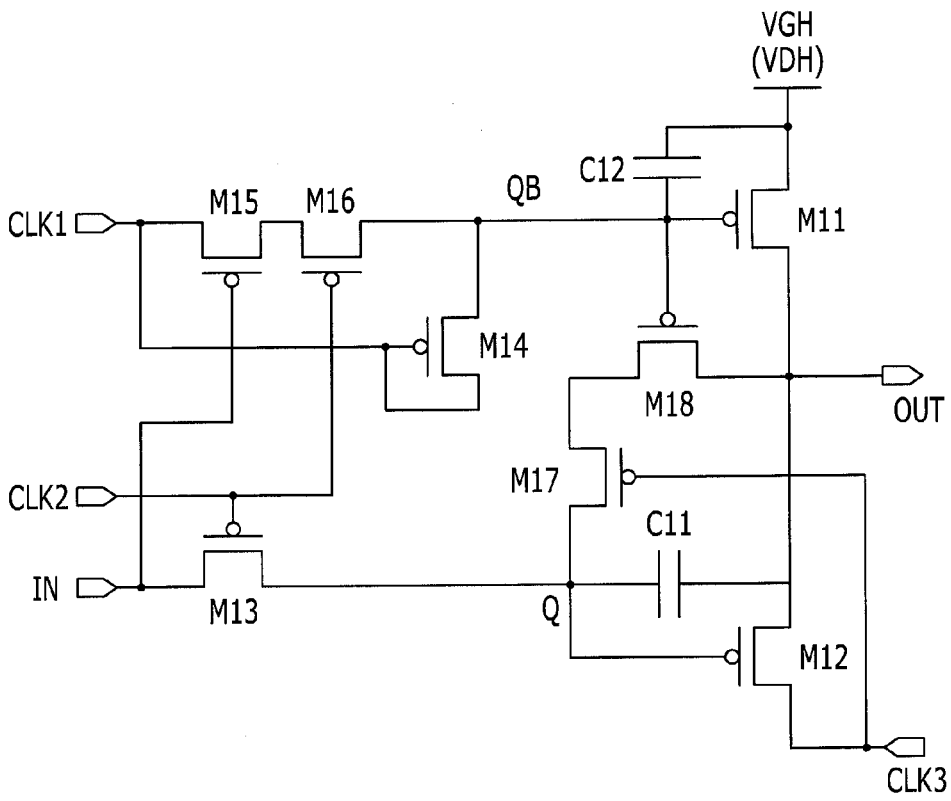
FIG. 4 is a circuit diagram of a scan driving block according to an exemplary embodiment of the present invention.

FIG. 4 is a circuit diagram of the scan driving block according to an exemplary embodiment of the present invention.

FIG. 4 illustrates the scan driving block included in the scan drivers of FIG. 2 and FIG. 3.

The scan driving block includes a plurality of transistors M11, M12, M13, M14, M15, M16, M17, and M18 and a plurality of capacitors C11 and C12.

The first transistor M11 includes a gate electrode coupled to a first node QB, a first electrode coupled to a power source voltage (i.e., VGH or VDH), and a second electrode coupled to the output terminal OUT.

The second transistor M12 includes a gate electrode coupled to a second node Q, a first electrode coupled to the third clock signal input terminal CLK3, and a second electrode coupled to the output terminal OUT.

The third transistor M13 includes a gate electrode coupled to the second clock signal input terminal CLK2, a first electrode coupled to the input signal input terminal IN, and a second electrode coupled to the second node Q.

The fourth transistor M14 includes a gate electrode coupled to the first clock signal input terminal CLK1, a first electrode coupled to the first clock signal input terminal CLK1, and a second electrode coupled to the first node QB.

The fifth transistor M15 includes a gate electrode coupled to the input signal input terminal IN, a first electrode coupled to the first clock signal input terminal CLK1, and a second electrode coupled to a first electrode of the sixth transistor M16.

The sixth transistor M16 includes a gate electrode coupled to the second clock signal input terminal CLK2, a first electrode coupled to the second electrode of the fifth transistor M15, and a second electrode coupled to the first node QB.

The fifth transistor M15 and the sixth transistor M16 are turned on together by an input signal input to the input signal input terminal IN and a clock signal input to the second clock signal input terminal CLK2, and transmit a clock signal transmitted to the first clock signal input terminal CLK1 to the first node QB. Accordingly, the locations of the fifth transistor M15 and the sixth transistor M16 may be exchanged, and in this case, the operation of the scan driving block is not changed.

The seventh transistor M17 includes a gate electrode coupled to the third clock signal input terminal CLK3, a first electrode coupled to the second node Q, and a second electrode coupled to a first electrode of the eighth transistor M18.

The eighth transistor M18 includes a gate electrode coupled to the first node QB, the first electrode coupled to the second electrode of the seventh transistor M17, and a second electrode coupled to the output terminal OUT.

The first capacitor C11 includes a first electrode coupled to the second node Q and a second electrode coupled to the output terminal OUT.

The second capacitor C12 includes a first electrode coupled to the power source voltage (i.e., VGH or VDH) and a second electrode coupled to the first node QB.

In one embodiment, the plurality of transistors M11 through M18 are p-channel field effect transistors. A gate-on voltage that turns on the plurality of transistors M11 through M18 is a logic low voltage, and a gate-off voltage that turns off the transistors M11 through M18 is a logic high voltage. The power source voltage VGH applied during the driving test is an AC voltage that is changed between the logic low level and the logic high level. The power source voltage VDH applied to the manufactured scan driver after completion of the driving test is a DC voltage of logic high.

In the present exemplary embodiment, the plurality of transistors M11 through M18 are described as the p-channel field effect transistors, but the plurality of transistors M11 through M18 may be n-channel field effect transistors. A gate-on voltage for turning on the n-channel field effect transistor is a logic high voltage, and a gate-off voltage for turning off the transistor is a logic low voltage.

Figure 5:
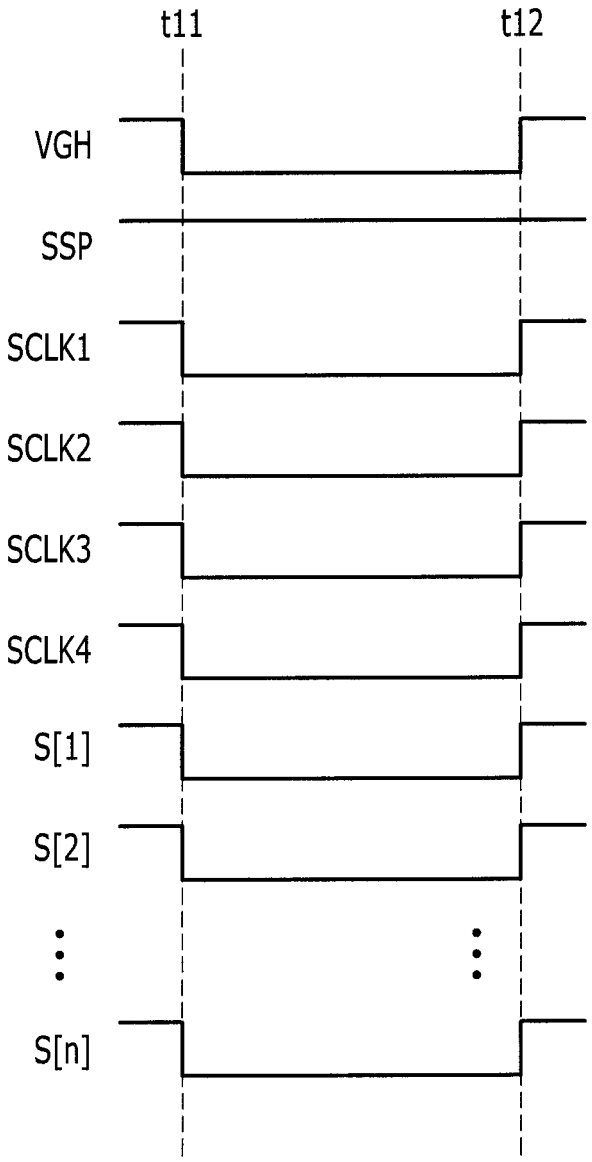
FIG. 5 is a timing diagram for describing a driving method of the scan driver during the pixel test according to an exemplary embodiment of the present invention.

FIG. 5 is a timing diagram for describing a driving method of the scan driver during the pixel test according to an exemplary embodiment of the present invention.

Referring to FIG. 2, FIG. 4, and FIG. 5, the first power source voltage wire p1 coupled to the plurality of scan driving blocks 210_1, 210_2, . . . , and 210_*n* included in the scan driver 200 during the pixel text is coupled to the AC power source unit 240. Accordingly, the plurality of scan driving blocks 210_1, 210_2, . . . , and 210_*n* are applied with the first power source voltage VGH that is changed between the logic low level and the logic high level.

A time period between t11 and t12 is a test period for performing a lighting and array test of a plurality of pixels by outputting the scan signals S[1], S[2], . . . , and S[n] of logic low level from the plurality of scan driving blocks 210_1, 210_2, . . . , and 210_*n* included in the scan driver 200. In the test period, the scan start signal SSP is floated or applied as a logic high voltage, and the plurality of clock signals SCLK1 to SCLK4 are applied as a logic low voltage. In addition, the first power source voltage VGH is changed from logic high level to logic low level at the time point t11 and maintains the logic low level during the test period.

In the period from t11 to t12, the plurality of clock signals SCLK1 to SCLK4 are applied as the logic low voltage, and accordingly the third transistor M13, the fourth transistor M14, and the seventh transistor M17 are turned on. The first node QB is applied with the logic low voltage, and the second node Q is applied with the logic high voltage. The first and eighth transistors M11 and M18 are turned on by the logic low voltage of the first node QB. The first power source voltage VGH of logic low level is output to the output terminal OUT through the turn-on first transistor M11. In addition, the logic high voltage of the second node Q is transmitted to the output terminal OUT through the turn-on seventh and eighth transistors M17 and M18.

Since the plurality of clock signals SCLK1 to SCLK4 are applied as the logic low voltage, the plurality of scan driving blocks 210_1, 210_2, . . . , and 210_*n* perform the same operation. That is, the plurality of scan driving blocks 210_1, 210_2, . . . , and 210_*n* concurrently (e.g., simultaneously) output the scan signals S[1], S[2], S[n] of logic low level.

When an error occurs in one of the plurality of scan driving blocks 210_1, 210_2, . . . , and 210_*n*, the scan driving block(s) after the error-occurred scan driving block cannot normally output a scan signal so that a lighting and array test of the pixels may not be properly performed.

As described above, all of the pixels can experience the lighting and array test when the plurality of scan driving blocks 210_1, 210_2, . . . , and 210_*n* concurrently (e.g., simultaneously) output the scan signals S[1], S[2], . . . , and S[n] of logic low level. When the scan signals are sequentially output, detection efficiency of the pixel test may be deteriorated, but when the scan signals are concurrently (e.g., simultaneously) output, the detection efficiency of the pixel test can be improved.

Figure 6:
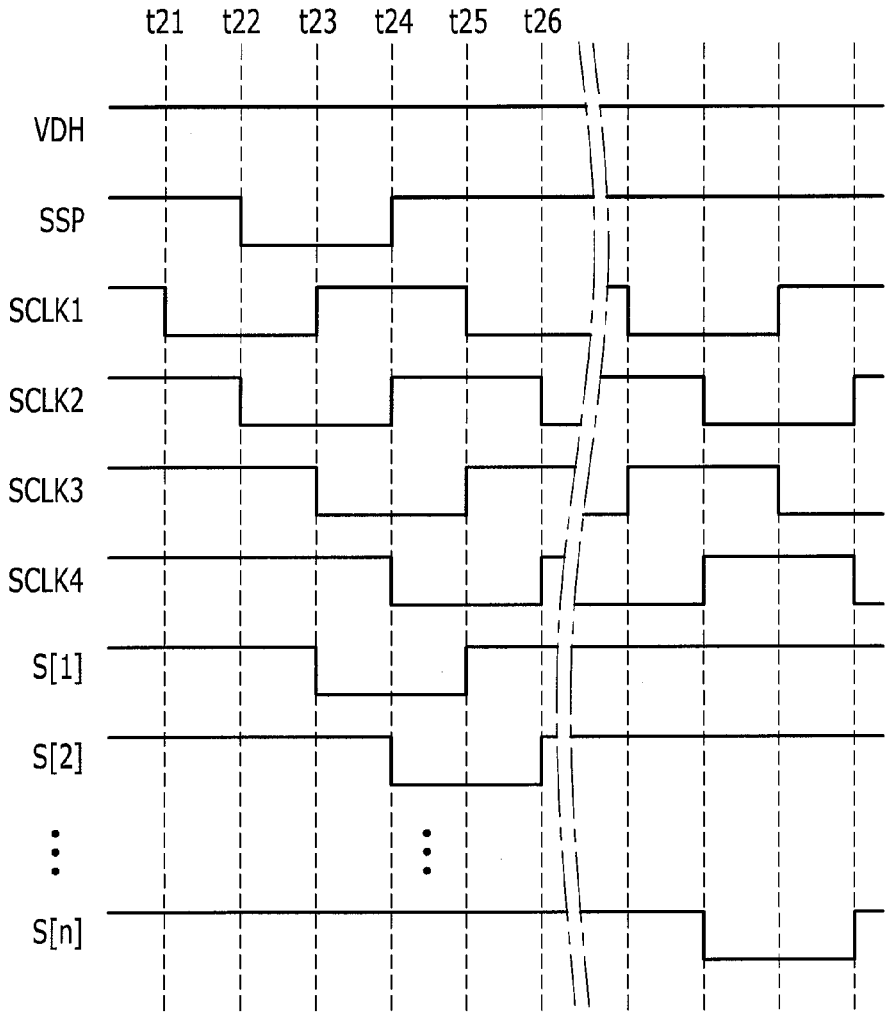
FIG. 6 is a timing diagram for describing a driving method of a manufactured scan driver after completion of the pixel test according to an exemplary embodiment of the present invention.

FIG. 6 is a timing diagram for describing a driving method of the manufactured scan driver after completion of the pixel test according to an exemplary embodiment of the present invention.

Referring to FIG. 3, FIG. 4, and FIG. 6, the first power source voltage wire p1 coupled to the plurality of scan driving blocks 210_1, 210_2, . . . , and 210_*n* included in the manufactured scan driver is coupled to the DC power source unit 230. Accordingly, the plurality of scan driving blocks 210_1, 210_2, . . . , and 210_*n* are supplied with the second power source voltage VDH of logic high level.

The manufactured scan driver sequentially outputs scan signals of logic low level in accordance with the start scan signal SSP and the plurality of clock signals SCLK1 to SCLK4.

The first clock signal SCLK1 is iteratively changed between a logic low level and a logic high level of a first period. The second clock signal SCLK2 is a signal that corresponds to the first clock signal SCLK1 and shifted by ½ duty from the first clock signal SCLK1. A duty of the clock signal refers to a period during which a transistor included in the scan driving block is in the turn-on state. The third clock signal SCLK3 is a signal that corresponds to the second clock signal SCLK2 and shifted by ½ duty from the second clock signal SCLK2. The fourth clock signal SCLK4 is a signal that corresponds to third clock signal SCLK3 and shifted by ½ duty from the third clock signal SCLK3. The four clock signals SCLK1 to SCLK4 respectively have different synchronization.

For better understanding and ease of description, the operation of the first scan driving block 210_1 will be described first. The first scan driving block 210_1 uses the first clock signal SCLK1, the second clock signal SCLK2, and the third clock signal SCLK3 among the four clock signals SCLK1 to SCLK4.

The scan start signal SSP is applied as a logic low voltage during a period from t22 to t24.

In the period from t21 to t22, the first clock signal SCLK1 is applied as a logic low voltage, and the second clock signal SCLK2 and the third clock signal SCLK3 are applied as logic high voltages. The fourth transistor M14 is turned on, and the logic low voltage is transmitted to the first node QB. The first transistor M11 is turned on, and the second power source voltage VDH of logic high level is transmitted to the output terminal OUT through the turn-on first transistor M11.

In a period from t22 to t23, the first clock signal SCLK1 and the second clock signal SCLK2 are applied as logic low voltages, and the third clock signal SCLK3 is applied as a logic high voltage. The third transistor M13, the fourth transistor M14, the fifth transistor M15, and the sixth transistor M16 are turned on by the signal of the logic low level. The first node QB and the second node Q receive the logic low voltages. The first transistor M11 is turned on by the logic low voltage of the first node QB, and the second power source voltage VDH is transmitted to the output terminal OUT through the turn-on first transistor M11. The second transistor M12 is turned on by the logic low voltage of the second node Q, and the logic high voltage is transmitted to the output terminal OUT through the turn-on second transistor M12. In this case, the first capacitor C11 is charged with a voltage corresponding to a voltage difference between the logic low voltage of the second node Q and the logic high voltage of the output terminal OUT.

In a period from t23 to t24, the second clock signal SCLK2 and the third clock signal SCLK3 are applied as logic low voltages, and the first clock signal SCLK1 is applied as a logic high voltage. The third transistor M13, the fifth transistor M15, the sixth transistor M16, and the seventh transistor M17 are turned on by the signals of the logic low level. The voltage of the logic low level is transmitted to the second node Q through the turn-on third transistor M13. The voltage of the logic high level is transmitted to the first node QB through the turn-on fifth and sixth transistors M15 and M16. The first transistor M11 and the eighth transistor M18 are turned off by the logic high voltage of the first node QB. As the third clock signal SCLK3 is changed to the logic low voltage, the second transistor M12 is substantially or completely turned on by bootstrap of the first capacitor C11. The logic low voltage is transmitted to the output terminal OUT through the turn-on second transistor M12.

In a period from t24 to t25, the third clock signal SCLK3 is applied as a logic low voltage, and the first clock signal SCLK1 and the second clock signal SCLK2 are applied as logic high voltages. The third transistor M13, the fourth transistor M14, the fifth transistor M15, and the sixth transistor M16 are turned off by the signal of logic high level. The first node QB is in the floating state, and the voltage of the first node QB maintains the logic high level. The second transistor M12 maintains the turn-on state, and the logic low voltage is continuously transmitted to the output terminal OUT.

As described, the first scan driving block 210_1 outputs a scan signal S[1] of logic low level during a period from t23 to t25. The scan signal S[1] of logic low level of the first scan driving block 210_1 is transmitted to the input signal input terminal IN of the second scan driving block 210_2.

In a period from t25 to t26, the first clock signal SCLK1 is applied as a voltage of logic low level, and the second and third clock signals SCLK2 and SCLK3 are applied as voltages of logic high level. The fourth transistor M14 is turned on by the first clock signal SCLK1, and the voltage of logic low level is transmitted to the first node QB. The first transistor M11 is turned on by the voltage of logic low level of the first node QB. The second power source voltage VDH is transmitted to the output terminal OUT through the turn-on first transistor M11.

The second scan driving block 210_2 uses clock signals SCLK2, SCLK3, SCLK4 that are respectively shifted by ½ duty from the clock signals SCLK1, SCLK2, SCLK3 that are used by the first scan driving block 210_1. Therefore the second scan driving block 2102 outputs a scan signal S[2] of logic low level shifted by ½ duty from the first scan driving block 210_1. With such a method, the plurality of scan driving blocks 210_1, 210_2, . . . , and **210_*n* sequentially output the scan signals S[1], S[2**], . . . , and S[n] of logic low level.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, it will be understood that those skilled in the art may perform various modifications and equivalent embodiments from the description. Accordingly, the technical scope of the present invention will be determined based on technical spirits of the claims and their equivalents.

DESCRIPTION OF SOME SYMBOLS

100: signal controller
200: scan driver
210: scan driving block
220: ESD unit
230: DC power unit
240: AC power unit
300: data driver
500: display unit

What is claimed is:

1. A display device comprising:

a display unit comprising a plurality of pixels coupled to a plurality of scan lines;

a plurality of scan driving blocks coupled to the plurality of scan lines and adapted to apply a plurality of scan signals;

an electrostatic discharge (ESD) unit adapted to protect the plurality of scan driving blocks from static charges;

an AC power source unit for supplying a first power source voltage of which a level is changed between a logic high level and a logic low level, to the plurality of scan driving blocks through a first power source voltage wire during a pixel test of the plurality of pixels; and a DC power source unit for supplying a second power source voltage of the logic high level to the ESD unit through a second power source voltage wire, wherein the first power source voltage wire is configured to be coupled to the DC power source unit and the first power source voltage wire is configured to be disconnected from the AC power source unit during normal operation, and wherein, during the pixel test, the first power source voltage wire is configured to be coupled to the AC power source unit, and after completion of the pixel test, the first power source voltage wire is configured to be coupled to the DC power source unit.

2. The display unit of claim 1, wherein each of the plurality of scan driving blocks comprises:

a first node configured to receive a clock signal input to a first clock signal input terminal;

a second node configured to receive an input signal according to a clock signal input to a second clock signal input terminal;

a first transistor including a gate electrode coupled to the first node, a first electrode configured to receive one of the first power source voltage or the second power source voltage, and a second electrode coupled to an output terminal; and a second transistor including a gate electrode coupled to the second node, a first electrode coupled to a third clock signal input terminal, and a second electrode coupled to the output terminal.

3. The display device of claim 2, wherein each of the plurality of scan driving blocks further comprises a first capacitor including a first electrode coupled to the second node and a second electrode coupled to the output terminal.

4. The display device of claim 3, wherein each of the plurality of scan driving blocks further comprises a second capacitor including a first electrode configured to receive one of the first power source voltage or the second power source voltage, and a second electrode coupled to the first node.

5. The display device of claim 4, wherein each of the plurality of scan driving blocks further comprises a third transistor including a gate electrode coupled to the second clock signal input terminal, a first electrode configured to receive the input signal, and a second electrode coupled to the second node.

6. The display device of claim 5, wherein each of the plurality of scan driving blocks further comprises a fourth transistor including a gate electrode coupled to the first clock signal input terminal, a first electrode coupled to the first clock signal input terminal, and a second electrode coupled to the first node.

7. The display device of claim 6, wherein each of the plurality of scan driving blocks further comprises:

a fifth transistor including a gate electrode to which the input signal is input and a first electrode coupled to the first clock signal input terminal; and a sixth transistor including a gate electrode coupled to the second clock signal input terminal, a first electrode coupled to a second electrode of the fifth transistor, and a second electrode coupled to the first node.

8. The display device of claim 7, wherein each of the plurality of scan driving blocks further comprises:

a seventh transistor including a gate electrode coupled to the third clock signal input terminal and a first electrode coupled to the second node; and an eighth transistor including a gate electrode coupled to the first node, a first electrode coupled to a second electrode of the seventh transistor, and a second electrode coupled to the output terminal.

9. The display device of claim 1, wherein the DC power source unit is adapted to supply a third power source voltage of the logic low level to the ESD unit through a third power source voltage wire.

10. A testing method of a display device comprising:

concurrently outputting a plurality of scan signals from a plurality of scan driving blocks by connecting a first power source voltage wire coupled to the plurality of scan driving blocks to an AC power source unit and changing a level of a first power source voltage applied to the first power source voltage wire; and connecting the first power source voltage wire to a DC power source unit that supplies a second power source voltage of a logic high level to an electrostatic discharge (ESD) unit that protects the plurality of scan driving blocks from static charges, through a second power source voltage wire, wherein the first power source voltage wire is configured to be coupled to the DC power source unit and the first power source voltage wire is configured to be disconnected from the AC power source unit during normal operation, and wherein, during a pixel test, the first power source voltage wire is configured to be coupled to the AC power source unit, and after completion of the pixel test, the first power source voltage wire is configured to be coupled to the DC power source unit.

11. The testing method of the display device of claim 10, wherein each of the plurality of scan driving blocks comprises: a first node to which a clock signal input to a first clock signal input terminal is transmitted; a first transistor having a gate electrode coupled to the first node and adapted to transmit one of the first power source voltage or the second power source voltage to an output terminal; and a capacitor including a first electrode coupled to one of the first power source voltage or the second power source voltage, and a second electrode coupled to the first node, and the concurrently outputting the plurality of scan signals from the plurality of scan driving blocks comprises:

changing a voltage of the first node by changing the first power source voltage;

turning on the first transistor by the voltage changing of the first node; and outputting the first power source voltage through the output terminal.

12. A driving method of a display device comprising a plurality of scan driving blocks, each of the scan driving blocks comprising: a first node to which a clock signal input to a first clock signal input terminal is transmitted; a second node to which an input signal is transmitted according to a clock signal input to a second clock signal input terminal; a first transistor including a gate electrode coupled to the first node and adapted to transmit a first power source voltage to an output terminal; and a second transistor including a gate electrode coupled to the second node and adapted to transmit a clock signal input to a third clock signal input terminal to the output terminal, the method comprising:

applying a second power source voltage to the plurality of scan driving blocks by connecting a first power source voltage wire that transmits the first power source voltage, to a DC power source unit that supplies the second power source voltage of a logic high level through a second power source voltage wire to an electrostatic discharge (ESD) unit that protects the plurality of scan driving blocks from static charges; and sequentially outputting a plurality of scan signals by applying a plurality of clock signals to the plurality of scan driving blocks.

13. The driving method of the display device of claim 12, wherein the sequentially outputting the plurality of scan signals comprises:

inputting a first clock signal to the first clock signal input terminal of each of the plurality of scan driving blocks;

inputting a second clock signal that is shifted by ½ duty from the first clock signal, to a second clock signal input terminal of each of the plurality of scan driving blocks;

inputting a third clock signal that is shifted by ½ duty from the second clock signal, to a third clock signal input terminal of each of the plurality of scan driving blocks; and outputting a scan signal synchronized by the third clock signal.

* * * * *